US006112800A

United States Patent [19]

Marusak

[11] Patent Number: 6,112,800

[45] Date of Patent: Sep. 5, 2000

[54] WINDOW TREATMENT SAFETY CLUTCH

[75] Inventor: Thomas Marusak, Loudonville, N.Y.

[73] Assignee: Comfortex Window Fashions, Watervliet, N.Y.

[21] Appl. No.: 09/149,201

[22] Filed: Sep. 8, 1998

[51] Int. Cl.[7] ..... E06B 9/56

[52] U.S. Cl. ..... 160/298; 160/319; 160/170 R

[58] Field of Search ..... 160/170 R, 171 R, 160/319, 298; 192/15, 17 R, 223

[56] References Cited

U.S. PATENT DOCUMENTS

| | | | |
|---|---|---|---|
| 12,881 | 5/1855 | Webster . | |
| 44,602 | 10/1864 | Campbell . | |
| 2,742,962 | 4/1956 | Griesser | 160/170 R |
| 2,756,030 | 10/1956 | Bechtler | 160/170 R |
| 2,894,577 | 7/1959 | Smith | 160/299 |
| 3,135,369 | 6/1964 | Nisenson et al. | 160/319 |
| 3,355,149 | 11/1967 | Wiegelmann | 160/170 R |
| 3,439,726 | 4/1969 | Lageson | 160/170 R |
| 4,088,171 | 5/1978 | Schluep et al. | 160/170 R |
| 4,909,298 | 3/1990 | Langhart et al. | 160/178.1 |
| 4,955,421 | 9/1990 | Torti | 160/170 R |
| 5,184,660 | 2/1993 | Jelic | 160/171 |
| 5,611,386 | 3/1997 | Wang | 160/170 R |
| 5,791,393 | 8/1998 | Judkins | 160/321 |
| 5,890,529 | 4/1999 | Haarer | 160/319 |

FOREIGN PATENT DOCUMENTS

| | | | |
|---|---|---|---|
| 281643 | 7/1952 | Switzerland | 160/170 R |
| 890867 | 3/1962 | United Kingdom | 160/319 |

*Primary Examiner*—Blair M. Johnson
*Attorney, Agent, or Firm*—Buchanan Ingersoll, P.C.

[57] ABSTRACT

A safety clutch is provided for operating a window treatment having a headrail, a bottomrail and a window covering material extending therebetween. The safety clutch is mounted on a movable frame within the headrail and is moved to rotatably engage the tube lift cord spool on which lift cords are wound and unwound to raise and lower the bottomrail. A brake mechanism connected to the headrail prevents rotating of the tube lift cord spool, and the brake is automatically disengaged upon operation of the safety clutch. A single pull cord is used to operate the safety clutch and the pull cord is maintained in a raised location when not in use.

17 Claims, 5 Drawing Sheets

WINDOW TREATMENT SAFETY CLUTCH

BACKGROUND OF THE INVENTION

1. Field of the Invention

This invention relates generally to window treatments, and more particularly, to a safety clutch device used with tube lifts in pleated shades, venetian blinds and other window treatments.

2. Description of the Prior Art

Window treatments such as shade assemblies and venetian blinds typically have window covering material or blind slats extending between a headrail and bottomrail and two or more lift cords connected to the bottomrail. Within the headrail is some type of cord locking device. Typically, two or more lift cords are connected at one end to the bottomrail and extend up through the window covering material or blind slats into the headrail. The lift cords then pass through a cord locking device and out of the headrail such that an opposite end of the lift cords is accessible to an operator. This type of blind can be seen in prior art FIG. 1.

Another type of blind has a tube lift in which the lift cords are wound around a tube within the headrail. An example of this type is shown in U.S. Pat. No. 5,184,660 issued on Feb. 9, 1993 to Jelic. By way of brief explanation, an endless looped pull cord is used to rotate a lift tube around which the window blind lift cords are wound and unwound in order to raise and lower the window blind. Usually a clutch is provided at one end of the tube lift. An endless cord is looped around a spool portion of the clutch to operate the lift system.

The lift cords of the window treatment present an attractive danger to infants or children who may play with the lift cords. There have been several instances in which children and infants have become entangled in the cords and accidentally hanged. This is more likely to occur when the lift cord is an endless loop as in FIG. 1 or the lift cords are tied together. Consequently, there has been a need for a lift system for window blinds that do not have a cord loop or tied lift cords.

In the past, attempts to reduce the danger associated with these lift cords have focused on moving the lift cords out of the accessible range of infants such as by tying or clipping the cords to shorten them or otherwise moving the lift cords away from floor level and away from the infants reach. Moving the cords out of the way after use is troublesome, and the operator must remember to move the cords after each use. Other attempts have focused on a detachable connection of the lift cords ends such as is disclosed in U.S. Pat. No. 4,909,298 to Langhart et al. Detachable lift cords require a certain level of force to detach. Moreover, tests of the commercially available embodiment of the Langhart patent have shown that this product failed to detach in simulated entanglements. Furthermore, the clutches currently in use for tube lift systems are designed to use a cord loop, not detachable lift cords. And although window treatments are designed to be aesthetically pleasing, none of the attempts of the prior art to reduce the dangers associated with lift cords are particularly aesthetically pleasing. Thus, there is a need in the industry to reduce the danger associated with lift cords in an efficient yet aesthetically pleasing manner.

It is therefore an object of the present invention to provide a window treatment having a lift mechanism which does not present a danger to infants or children.

SUMMARY OF THE INVENTION

The present invention provides a window treatment comprising a headrail adapted to be secured to a window frame and a bottomrail. A lift cord spool is rotatably attached to the headrail and includes a lift cord having one end attached to the bottomrail and an opposite end secured to the lift cord spool. A window covering material is disposed between the bottomrail and the headrail, the window covering material having an end attached to the bottomrail and movable therewith. A brake mechanism is provided for preventing rotation of the lift cord spool. A safety clutch is operably connected to the headrail and is rotatably engaged with the lift cord spool in an operating position to raise the lift cord and bottomrail and the brake mechanism is released from the lift cord spool. The safety clutch is operated by a single pull cord which is maintained in an upward location in an at rest position. In this manner the cord for raising and lowering the window treatment is kept raised and out of harms way in its normal or at rest position.

BRIEF DESCRIPTION OF THE DRAWINGS

Various objects, features and advantages of the invention will become more apparent by reading the following detailed description in conjunction with the drawings, which are shown by way of example only, wherein.

DETAILED DESCRIPTION OF THE PREFERRED EMBODIMENTS

Figure 2:
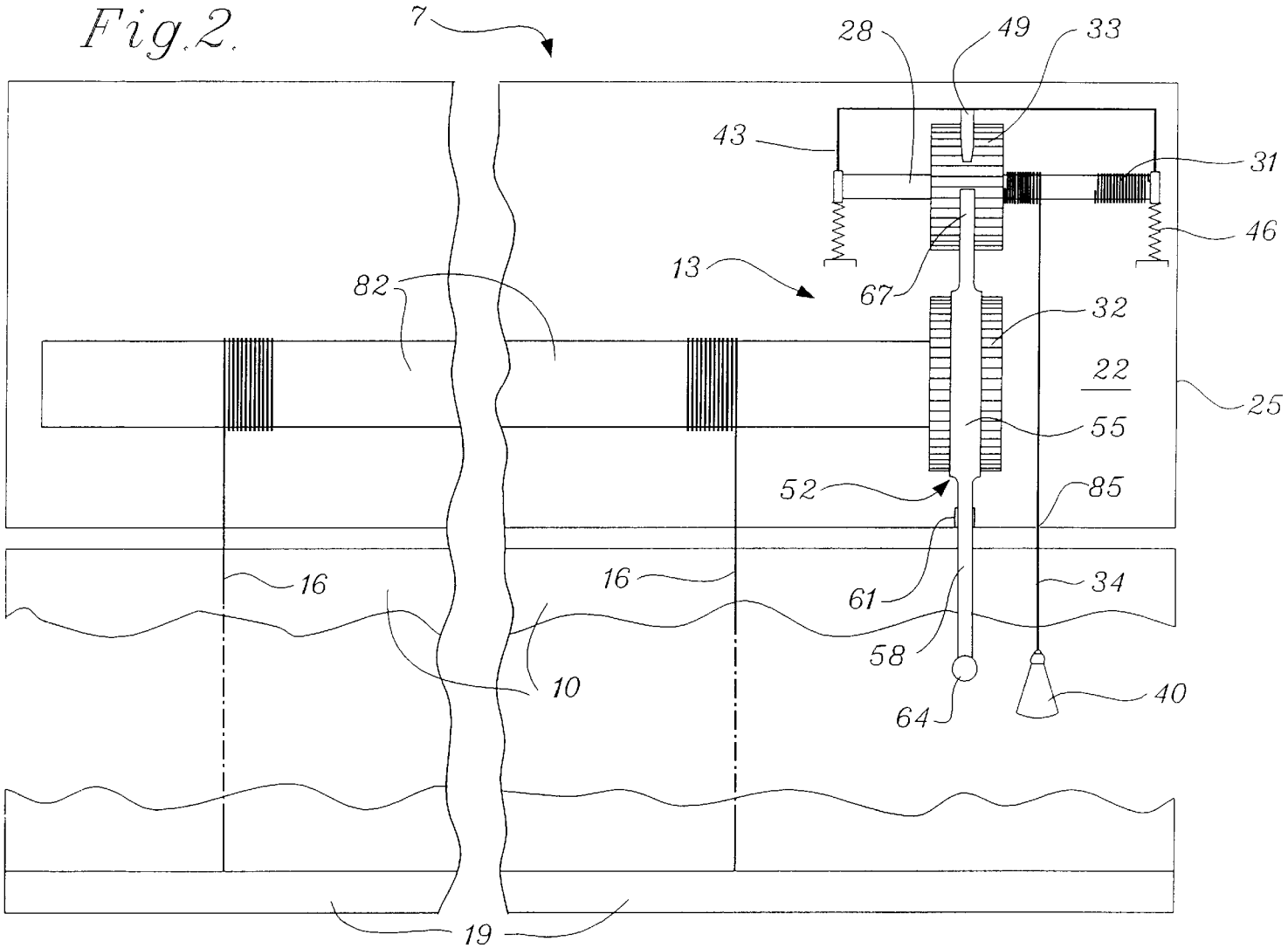
FIG. 2 is a front, partially cut away, view of a window treatment according to the present invention.

Referring now to the drawings in detail, FIG. 2 shows a front partially cut away view of a window treatment 7 according to the present invention. As is typical, the window treatment has a headrail 25, bottomrail 19 and window covering material 10 extending between them. The window covering material is raised or lowered by lift cords 16 wound on a lift tube or spool 13. The window covering material 10 may be pleated fabric, roman shade fabric or venetian blind slats on ladders. The lift cords 16 press through the window covering material and are attached at their opposite ends to the bottomrail 19. Raising or lowering of the window covering material is accomplished by winding and unwinding the lift cords 16 about the lift tube 13 using clutch 22 shown most clearly in FIGS. 3A and 3B. Mounted above the lift cord spool is a pull cord spool 28. The pull cord spool is spring loaded, such as a by a coil spring 31, in order to urge the pull cord spool to rotate in a first direction (i.e., counter clockwise in the figure), and is adapted to be engaged with the tube lift cord spool 13. Preferably the outer diameters of both the tube lift cord spool and the pull cord spool are geared 32, 33 respectively, so as to be more directly rotatably engaged. The pull cord spool is operated by a pull cord 34, which passes over a roller 37 and has attached to its opposite end a tassel 40. The safety clutch 22 of the present invention operates to automatically lift the pull cord 34 upward so that it is not readily accessible to small children in the nonoperating or at rest position.

The pull cord spool 28 is mounted on a pull cord spool frame 43 which is spring loaded by a disengagement spring 46 between the pull cord spool frame and a fixed portion of the window treatment, such as the headrail 25, which can be secured in a conventional way to the window frame (not shown). In its unoperated or at rest position, the disengagement spring 46 maintains the pull cord spool 28 separated from the tube lift cord spool 13 (see FIG. 3B), in a manner which will be more fully described hereinafter. Attached to a portion of the pull cord spool frame is a wedge 49.

Figure 3A:
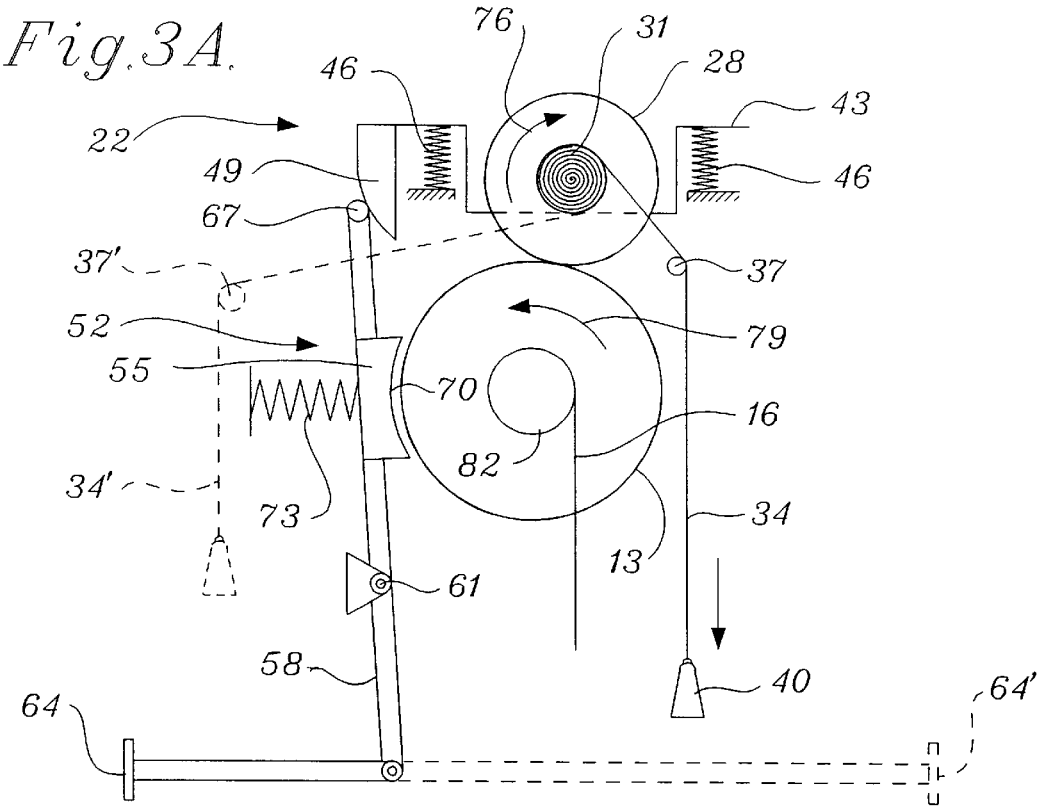
FIG. 3, consisting of FIGS. 3A and 3B, is a schematic side view of the window treatment of FIG. 2, showing the safety clutch of the present invention in its operating and nonoperating position, respectively.
Figure 3B:
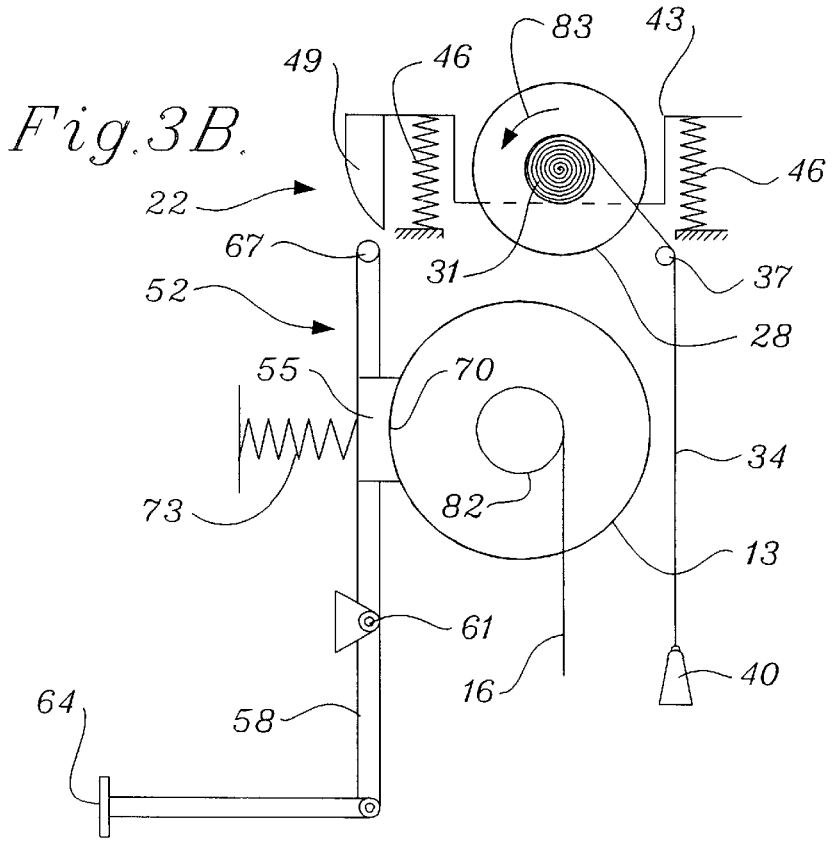

Operatively associated with the lift cord spool 13 is a brake mechanism 52 for preventing rotation of the tube lift cord spool 13. A brake 55 is pivotally mounted to the headrail 25 such as by the brake lever arm 58 and brake lever fulcrum 61, and can be operated by a brake release push pin 64. Brake lever arm 58 extends from the brake release push pin, cooperates with the brake lever fulcrum 61, and extends upward to a brake release arm 67 which engages the brake release wedge 49, as will be discussed hereinafter. Intermediate the fulcrum 61 and the brake release arm 67 is the brake 55 which is adapted to engage the tube lift cord spool 13. Preferably the brake has a curved surface 70 which substantially matches the outside diameter of the lift cord spool (see FIG. 3B). A spring 73 is mounted to the brake opposite the tube lift cord spool and is designed to maintain the brake 55 in contact with the lift cord spool 13 in the at rest or nonoperating position. In FIGS. 3A and 3B, the push pin 64 is shown on the opposite side of the clutch from pull cord 34. However, both should be on the same side of the window treatment 7. This can be accomplished using optional push pin 64' shown in chain line or routing the cord 34' over optional roller 37', also shown in chain line in FIG. 3A.

Lifting Bottomrail

The window treatment safety clutch is shown in FIG. 3A in its operating position for lifting the bottomrail 19, and hence raising the window covering material. Pulling down on the pull cord 34 causes the pull cord spool frame 43 and the pull cord spool 28 to move in a direction toward tube lift cord spool 13. This movement causes the downward motion of brake release wedge 49 to push the brake release arm 67 to move the brake 55 to disengage from the tube lift cord spool 13. Thus, the tube lift cord spool 13 is free to rotate with the rotation of the pull cord spool 28. At the same time, the downward motion of the pull cord spool frame causes the geared circumference 33 of the pull cord spool 28 to engage the mating geared circumference 32 of the tube lift cord spool 13. Continued downward pressure on the pull cord 34 causes the pull cord spool to rotate in a clockwise direction, as shown by the arrow 76 thereon. The clockwise rotation 76 of the pull cord spool 28 causes a corresponding counter clockwise rotation of the lift cord spool 13, as shown by a second arrow 79 thereon. As the pull cord is continued to be pulled downward, the counter clockwise rotation of the lift cord spool causes the lift cord 16 to be pulled upward and continually wrapped around a drum 82 on the tube lift cord spool 13. Continued upward momentum of the lift cord pulls the bottomrail 19 upward thus pulling the entire window covering material 10 upward. The clockwise rotation of the pull cord spool 28 causes winding of the coil spring 31.

Release of Pull Cord

When the bottomrail 19 has been raised upward to its desired position for the window covering material, the operator need only allow the pull cord 34 to move slightly upward allowing springs 46 to move pull cord spool frame 43 upward disengaging the pull cord spool 28 from the tube lift cord spool 13. This also disengages the wedge 49 from the brake release arm 67, allowing the brake release arm 67 to move toward the lift cord spool due to the force exerted in that direction by the brake force spring 73. This re-engages the brake 55 with the tube lift cord spool 13, preventing it from rotating under the influence of the tension in the lift cords 16 caused by the weight of the bottomrail 19. The disengagement spring 46 forces the pull cord spool 28 upward out of engagement with the tube lift cord spool 13. Releasing the pull cord 34 allows the coil spring 31 to unwind and rotate the pull cord spool (as indicated by arrow 83 in FIG. 3B) to wind the pull cord 34 thereon to retract it upward, out of harms reach. As shown in FIG. 2, a tassel stop 85 is provided on the headrail. The tassel stop 85 ensures that the tassel 40 can be readily grasped for proper operation of the window treatment. In this manner, the pull cord is immediately raised upward so as to be out of the reach of small children, thereby giving the desired safety advantage of the present invention.

Lowering the Bottomrail

In the static condition (FIG. 3B), brake 55 is engaged with the tube lift cord spool 13 preventing it from rotating, and further preventing the bottomrail 19 from moving. When it is desired to lower the bottomrail 19 and hence the window treatment 22, the brake release pin 64 may be pushed to the right (in the direction of the lift cord spool as shown in the figure). This action causes the brake lever arm 58 to pivot in such a manner about the brake lever fulcrum 61 that it causes the brake 55 to move away from and disengage the tube lift cord spool 13. This allows the lift cord spool to freely rotate.

The weight of the bottomrail 19 causes the shade to lower, since the tube lift cord spool freely rotates. The brake 55 can be held in slight engagement with the tube lift cord spool 13 so as control the lowering of the window treatment 22. When the shade is at its desired position, the operator need only disengage the brake release push pin 64, the brake spring 74 thus fully engaging the brake 55 against the tube lift cord spool 13.

Stopping the Bottomrail

Disengaging of the rightward directional force on brake release push pin will enable the brake force spring 73 to push the brake 55 toward the tube lift cord spool 13, engaging the lift cord spool so as to stop it from rotating. This, in turn, prevents the lift cord(s) from unwinding, which also prevents the bottomrail from moving downward. Pulling on the tassel and pull cord would start the action over again, causing the bottom rail to begin to lift upwards. The diameter of the pull cord spool and the lift cord(s) spool may be different so as to provide motion or force amplification as desired. Alternatively intermediate gears can be provided between the pull cord spool and the tube lift cord spool 13.

Figure 1:
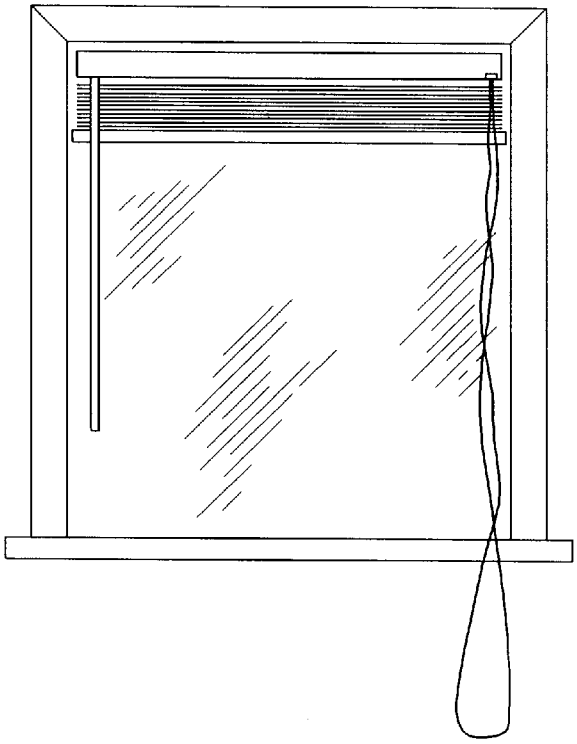
Fig.1. Prior Art
FIG. 1 shows a typical prior art window treatment assembly utilizing a looped lift cord.
Figure 4:
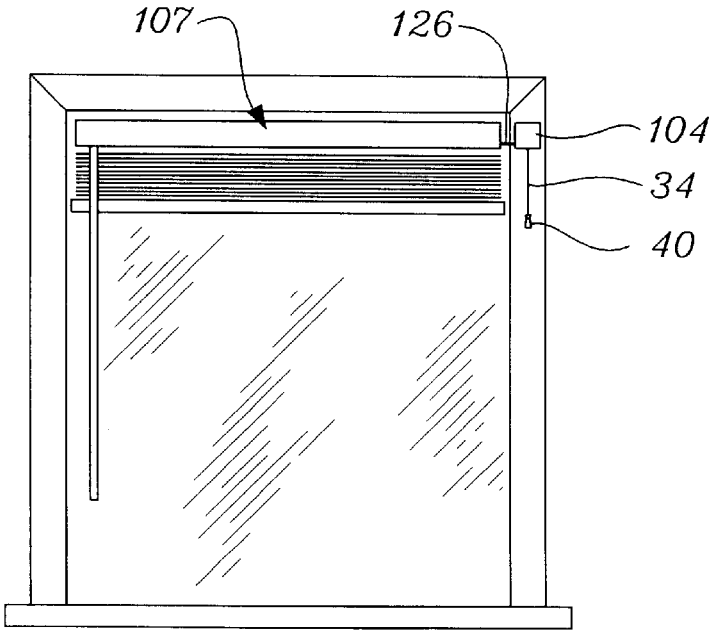
FIG. 4 is an alternative embodiment of the present invention, showing the safety clutch of the present invention used in conjunction with an existing window treatment.
Figure 5:
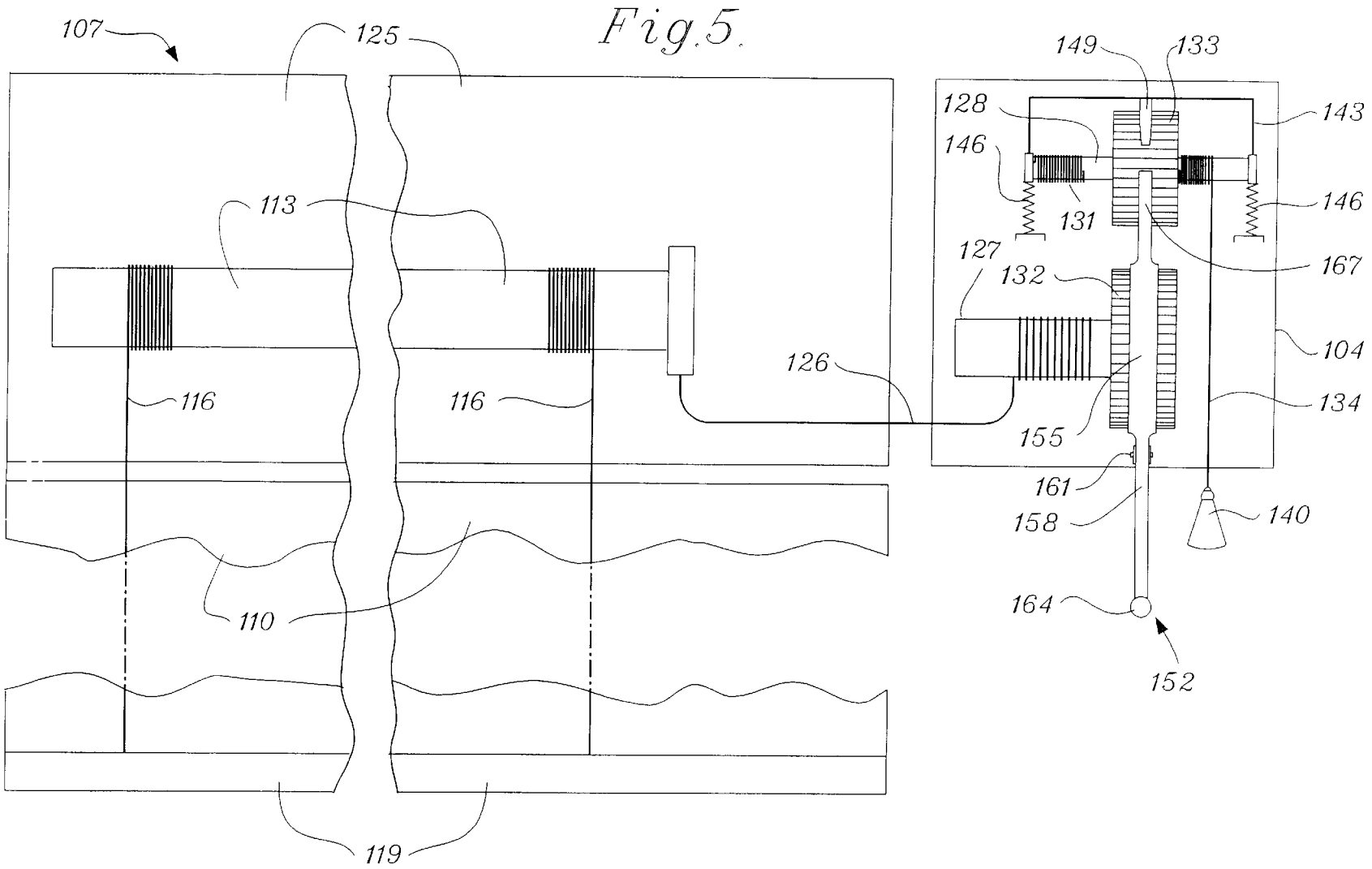
FIG. 5 is a detailed cut away view of the embodiment shown in FIG. 4 connected to a blind having a tube lift.

Referring now to FIGS. 4 and 5, an alternative embodiment comprising a separate clutch unit 104 of the present invention can be used in conjunction with a conventional prior art window treatment 107. As is typical, the window treatment is comprised of a headrail 125, bottomrail 119 and window covering material 110 extending between them. As previously, the window covering materials are raised or lowered by lift cords 116 wound on a lift tube 113. In contrast to the conventional window treatment shown in FIG. 1 its pull cord 126, rather than hanging down loosely and presenting a hazard for small children, is wrapped around a clutch pull cord drum 127 which is part of the window treatment safety clutch mounted as a separate stand alone unit 104 such as on the window frame.

In principle, the operation of the window treatment safety clutch is much the same as is the integral unit discussed previously. A pull cord spool 128 is mounted above the clutch pull cord drum 127 upon which the window treatment pull cord 126 is wrapped. The pull cord spool 128 is spring loaded, such as by coil spring 131, in order to urge the pull cord spool 128 to rotate in a direction to wind the window treatment pull cord 126 on the drum 127. Winding of the window treatment pull cord 126 causes a corresponding rotation of the lift tube 113 and lift cord 116, in any well known manner. Again, the outer diameters of both the clutch pull cord drum 127 and the pull cord spool 128 have gears 132, 133, respectively, so as to be more directly rotatably engaged. The pull cord spool 128 is operated by the clutch pull cord 134, which passes over a roller (not shown) and has attached to its opposite end a tassel 140. Also, the clutch pull cord spool 128 is mounted on a pull cord spool frame 143 which is spring loaded by disengagement spring 146 mounted between the pull cord spool frame and a fixed portion of the window treatment safety clutch unit 104, which is secured in a conventional way to the window frame as shown in FIG. 4. This embodiment also includes a brake mechanism 152 for preventing rotation of the lift cord spool. A brake 155 is pivotally mounted to the safety clutch housing such as by a brake lever arm 158 and brake lever fulcrum 161 and is operated by a brake release push pin 164. The upper portion of the brake release arm 167 engages the brake release wedge 149 substantially in the same manner as discussed previously.

Figure 6:
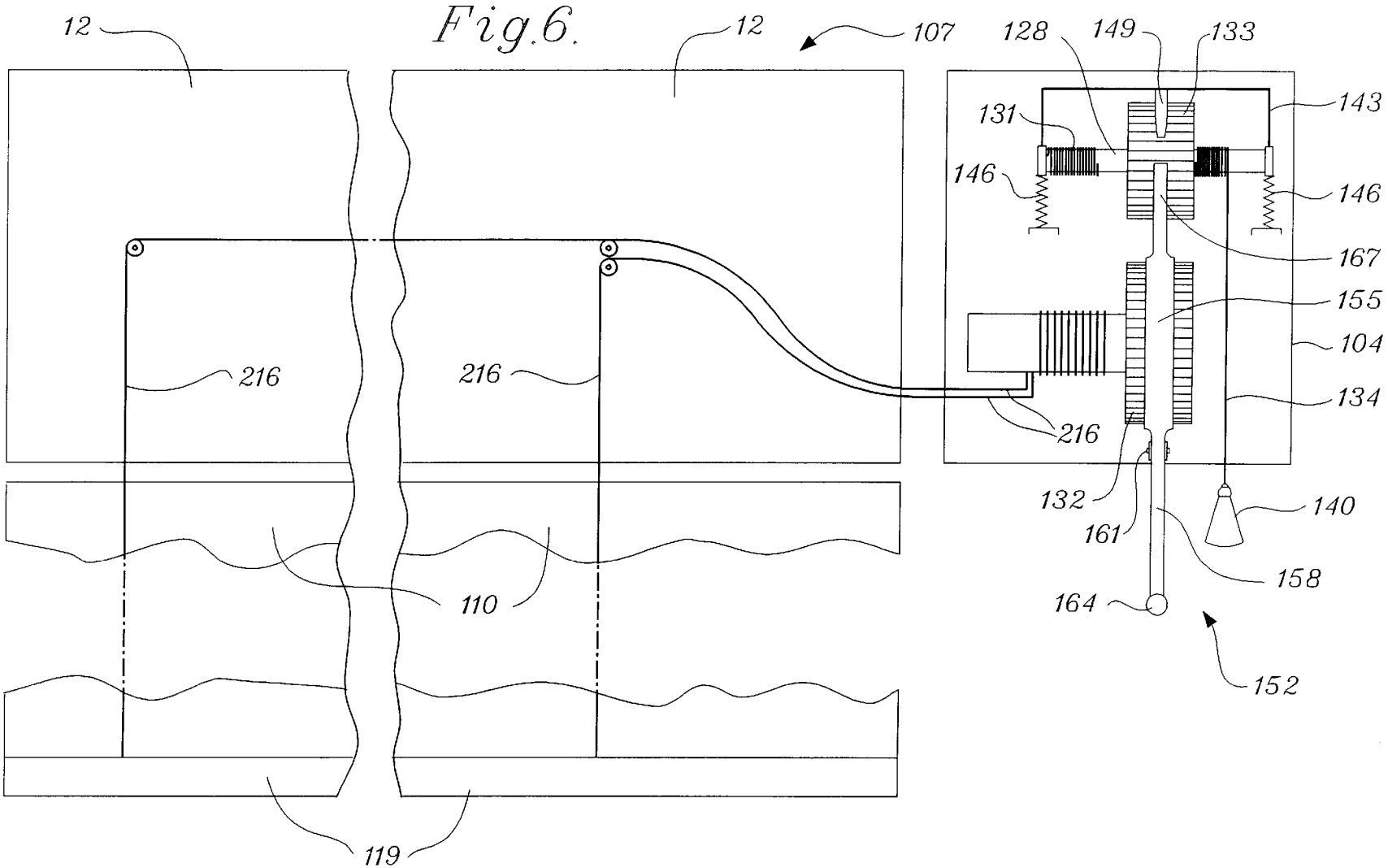
FIG. 6 is a cut away view of the embodiment shown in FIG. 4 connected to a blind in which the lift cords pass through the headrail.

The clutch unit 104 could also be used on blinds of the type shown in FIG. 6 in which the lift cords 216 pass through the headrail. When used with that type of blind, the lift cords 216 would be wrapped around clutch pull cord drum 127. The unit 104 would otherwise be the same as shown in FIG. 5.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as to the scope of the invention which is to be given the full breadth of the appended claims and in any and all equivalents thereof.

What is claimed is:

1. A window treatment comprising:

a headrail adapted to be secured to a window frame;

a bottomrail;

a tube lift cord spool rotatably attached to the headrail;

a lift cord having one end attached to the bottomrail and an opposite end secured to the tube lift cord spool so as to be wound and unwound about the tube lift cord spool;

a window covering material disposed between the bottomrail and the headrail, the window covering material having an end attached to the bottomrail and movable therewith;

a brake mechanism connected to the headrail and positioned to engage the tube lift cord spool for preventing rotation of the tube lift cord spool; and a safety clutch attached to a movable frame is operably connected to the headrail wherein the movable frame can be moved to a first position in which the safety clutch is rotatably engaged with the tube lift cord spool in an operating position to raise the lift cord and bottomrail and can be moved to a second position in which the safety clutch is disengaged from the tube lift cord spool.

2. The window treatment of claim 1, wherein the safety clutch comprises:

a pull cord spool adapted to rotatably engage the tube lift cord spool;

a spring connected to the pull cord spool, the spring urging the pull cord spool to rotate in a first direction; and a pull cord wound around the pull cord spool such that as the pull cord is unwound the spring is placed in tension and releasing the pull cord will allow the spring to rotate the pull cord spool causing the pull cord to rewind on the pull cord spool.

3. The window treatment as recited in claim 1, also comprising means attached to the movable frame for disengaging the brake from the tube lift cord spool upon manipulation of a pull cord, such that a pull cord spool is rotatably engaged with the tube lift cord spool in an operating position and the pull cord spool is caused to rotate in the second direction to cause a corresponding rotation of the tube lift cord spool in order to operate the window treatment.

4. The window treatment as recited in claim 3, further comprising gears on the outer diameter of each of the pull cord spool and tube lift cord spool.

5. The window treatment as recited in claim 1, wherein the brake mechanism further comprises:

a brake operatively associated with the tube lift cord spool;

a lever arm, the brake being connected to an intermediate portion of the lever arm;

a fulcrum pivotally mounting the lever arm with respect to the tube lift cord spool, said fulcrum being connected to the lever arm at a first end thereof; and a brake spring for urging the brake against the tube lift cord spool in the at rest position.

6. The window treatment as recited in claim 5, also comprising a wedge attached to the movable frame adjacent the lever arm, such that manipulation of the pull cord urges the wedge into contact with the lever arm such that the lever arm is caused to disengage the brake from the lift cord spool.

7. The window treatment as recited in claim 1, wherein the window covering material is comprised of slats.

8. The window treatment as recited in claim 1, wherein the window covering material is comprised of pleated fabric.

9. The window treatment as recited in claim 1, wherein the window covering material is comprised of a roman shade.

10. A safety clutch for a window treatment of the type having a pull cord for raising and lowering the window treatment, the safety clutch comprising:

a pull cord drum for winding and unwinding the pull cord;

a brake mechanism positioned to engage the pull cord drum for preventing rotation of the pull cord drum;

a pull cord spool adapted to rotatably engage the pull cord drum, the pull cord spool being mounted in such a manner that the pull cord spool can be moved to a first position in which the pull cord spool is rotatably engaged with the pull cord drum in an operating position to raise the window treatment and can be moved to a second position in which the pull cord spool is disengaged from the pull cord drum;

a spring connected to the pull cord spool, the spring urging the pull cord spool to rotate in a first direction; and a clutch pull cord wound around the pull cord spool such that as the clutch pull cord is unwound the spring is placed in tension and releasing the clutch pull cord will allow the spring to rotate the pull cord spool causing the clutch pull cord to rewind on the pull cord spool.

11. The safety clutch as recited in claim 10, also comprising a movable frame to which the pull cord spool is mounted.

12. The safety clutch as recited in claim 11, also comprising means attached to the movable frame for disengaging the brake mechanism from the pull cord drum upon manipulation of the clutch pull cord, such that the pull cord spool is rotatably engaged with the pull cord drum in an operating position and the pull cord spool is caused to rotate in a second direction to cause a corresponding rotation of the pull cord drum in order to operate the window treatment.

13. The safety clutch as recited in claim 11, wherein the brake mechanism further comprises:

a brake operatively associated with the pull cord drum;

a lever arm, the brake being connected to an intermediate portion of the lever arm;

a fulcrum pivotally mounting the lever arm with respect to the pull cord drum, said fulcrum being connected to the lever arm at a first end thereof; and a brake spring for urging the brake against the pull cord drum in the at rest position.

14. The safety clutch as recited in claim 13, also comprising a wedge attached to the movable frame adjacent a second end of the lever arm, such that manipulation of the clutch pull cord urges the wedge into contact with the second end of the lever arm such that the lever arm is pivoted to disengage the brake from the pull cord drum.

15. The safety clutch as recited in claim 10, further comprising gears on the outer diameter of each of the pull cord spool and pull cord drum.

16. The safety clutch as recited in claim 10, wherein the brake mechanism further comprises:

a brake operatively associated with the pull cord drum;

a lever arm, the brake being connected to an intermediate portion of the lever arm;

a fulcrum pivotally mounting the lever arm with respect to the pull cord drum, said fulcrum being connected to the lever arm at a first end thereof; and a brake spring for urging the brake against the pull cord drum in the at rest position.

17. The safety clutch as recited in claim 16, also comprising a wedge attached to the movable frame adjacent the lever arm, such that manipulation of the clutch pull cord urges the wedge into contact with the lever arm such that the lever arm is caused to disengage the brake from the pull cord drum.

* * * * *

UNITED STATES PATENT AND TRADEMARK OFFICE

CERTIFICATE OF CORRECTION

PATENT NO. : 6,112,800

DATED : September 5, 2000

INVENTOR(S) : THOMAS MARUSAK

It is certified that error appears in the above-indentified patent and that said Letters Patent is hereby corrected as shown below:

Title page, item

At [56] References Cited, change "2,756,030" to —2,765,030—.

Signed and Sealed this

First Day of May, 2001

*Attest:*

Nicholas P. Godici

NICHOLAS P. GODICI

*Attesting Officer*

*Acting Director of the United States Patent and Trademark Office*